US011148931B1

(12) United States Patent
Bolden

(10) Patent No.: US 11,148,931 B1
(45) Date of Patent: Oct. 19, 2021

(54) CONTROL DEVICE FOR A FUEL DISPENSING NOZZLE

(71) Applicant: Tyshone Daniel Bolden, Clermont, FL (US)

(72) Inventor: Tyshone Daniel Bolden, Clermont, FL (US)

( * ) Notice: Subject to any disclaimer, the term of this patent is extended or adjusted under 35 U.S.C. 154(b) by 0 days.

(21) Appl. No.: 17/149,501

(22) Filed: Jan. 14, 2021

(51) Int. Cl.
*B67D 7/42* (2010.01)
*B67D 7/32* (2010.01)

(52) U.S. Cl.
CPC ..... *B67D 7/42* (2013.01); *B67D 7/3281* (2013.01)

(58) Field of Classification Search
CPC ..... B67D 7/42; B67D 7/3281; B67D 7/50; Y10T 74/2063
USPC ..... 141/392
See application file for complete search history.

(56) References Cited

U.S. PATENT DOCUMENTS 4,210,181 A * 7/1980 Clevenger ..... B67D 7/50 141/392
4,236,552 A * 12/1980 Rayboy ..... B67D 7/50 141/392
4,337,917 A * 7/1982 Tesack ..... B67D 7/50 141/392
5,040,769 A * 8/1991 Wilber ..... G05G 1/54 251/90
5,517,732 A * 5/1996 Crear ..... B67D 7/50 141/392
6,832,636 B2 * 12/2004 Harrison ..... C07K 14/47 141/1
7,096,758 B1 * 8/2006 Ferkany ..... B67D 7/50 81/119
10,689,244 B1 * 6/2020 LeCroix ..... B67D 7/42
2003/0168121 A1 * 9/2003 Smith ..... B67D 7/50 141/392
2005/0061397 A1 * 3/2005 Mendicino ..... B67D 7/42 141/392
2006/0185765 A1 * 8/2006 Bates, III ..... B67D 7/50 141/392
2014/0263318 A1 * 9/2014 Webster ..... B60K 15/0406 220/212.5
2020/0268219 A1 * 8/2020 Yeo ..... B67D 7/426

FOREIGN PATENT DOCUMENTS

GB 2319514 A * 5/1998 ..... G05G 1/54

* cited by examiner

*Primary Examiner* — Timothy P. Kelly
*Assistant Examiner* — Stephanie A Shrieves
(74) *Attorney, Agent, or Firm* — Jason T. Daniel, Esq.; Daniel Law Offices, P.A.

(57) ABSTRACT

A control device for a fuel dispensing nozzle includes a main body having a handle extending upward from the top surface, and a pair of elongated hooks extending downward from the main body. Each of the hooks being oriented perpendicular to the main body and functioning to receive and engage a handle portion of a fuel dispensing nozzle. A controller having a control grip and a lever hook is slidingly and rotationally engaged with the main body.

11 Claims, 4 Drawing Sheets

CONTROL DEVICE FOR A FUEL DISPENSING NOZZLE

TECHNICAL FIELD

The present invention relates generally to personal protective equipment, and more particularly to a personal control device for a fuel dispensing nozzle.

BACKGROUND

The statements in this section merely provide background information related to the present disclosure and may not constitute prior art.

Owing to the recent spread and transmission of communicable viruses such as the COVID-19 pandemic of 2020, for example, doctors and governments around the world are asking individuals to practice social distancing and to avoid touching surfaces that are accessed by others.

However, everyday millions of individuals must visit a gas station to fuel their vehicles. Because of their outdoor location, the fuel nozzles and associated controls of the gas pumps are rarely (if ever) cleaned and sanitized. As such, gas pumps are among the most dirty and contaminated objects routinely encountered by most individuals.

Indeed, due to the rarity of cleaning and proper inspection, many users routinely encounter hazards while accessing gas pumps. Several examples include the presence of insects such as ants and spiders which may nest along the bottom surface of the nozzle handle and sting a user's hand when grasping the same. Another issue results from criminal activities wherein someone places sharp objects such as broken glass or needles into the handle surface with the intent of harming the next individual to grasp the nozzle.

Accordingly, it would be beneficial to provide a personal control device which can be used by an individual to safely access a gas pump or other such object so as to eliminate the drawbacks and concerns expressed above.

SUMMARY OF THE INVENTION

The present invention is directed to a control device for a fuel dispensing nozzle. One embodiment of the present invention can include a main body having a handle extending upward from the top surface, and a pair of elongated hooks extending downward from the main body. Each of the hooks being oriented perpendicular to the main body and functioning to receive and engage a handle portion of a fuel dispensing nozzle.

In one embodiment, a controller can be positioned along the back end of the main body. The controller can include an elongated rod having a control grip along the top surface and a lever hook along the bottom surface. The controller can be slidingly engaged with the main body so as to allow a user to selectively move the lever hook vertically and rotate the lever hook 360 degrees.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
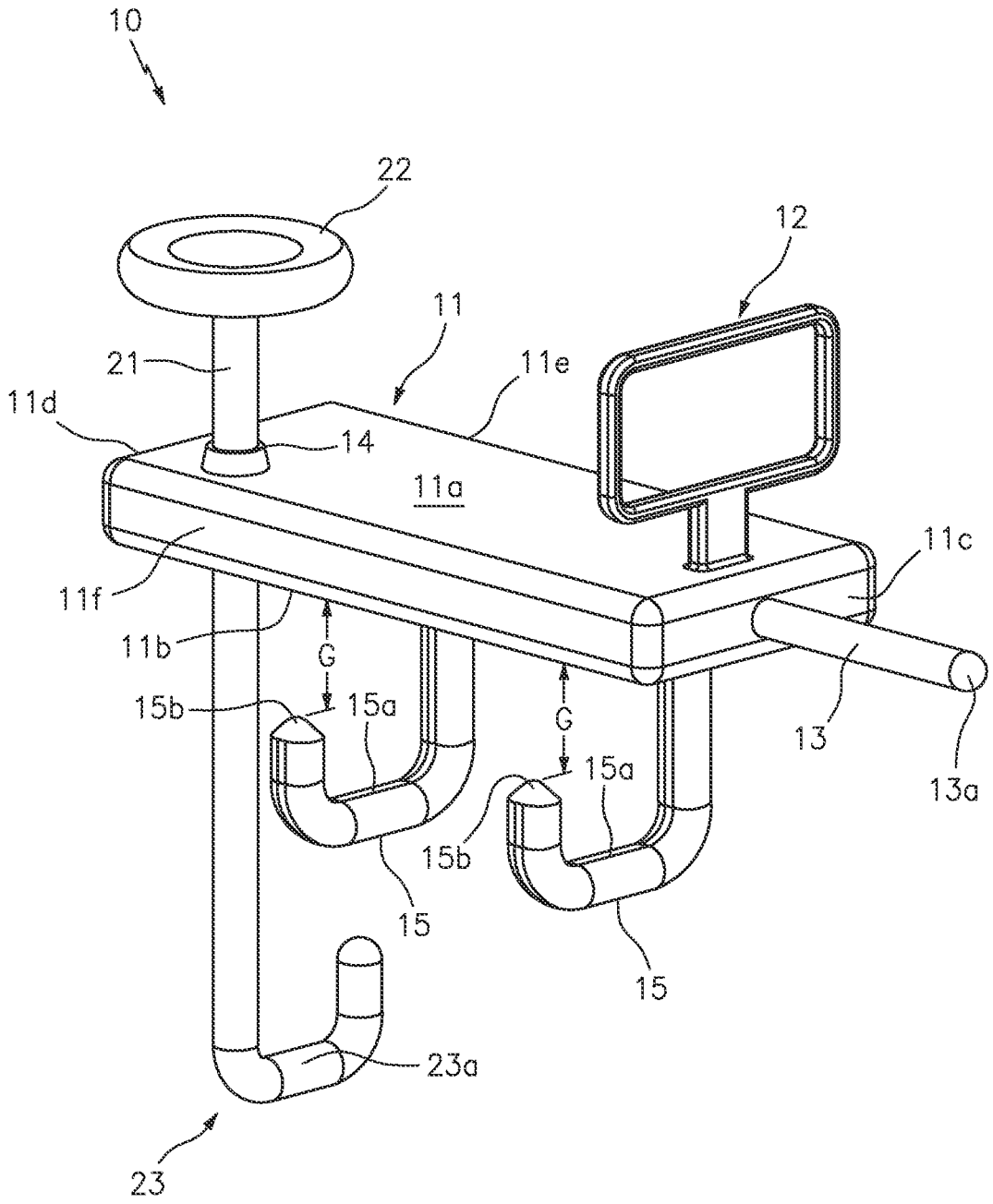
FIG. 1 is a perspective view of a control device for a fuel dispensing nozzle that is useful for understanding the inventive concepts disclosed herein.
Figure 2:
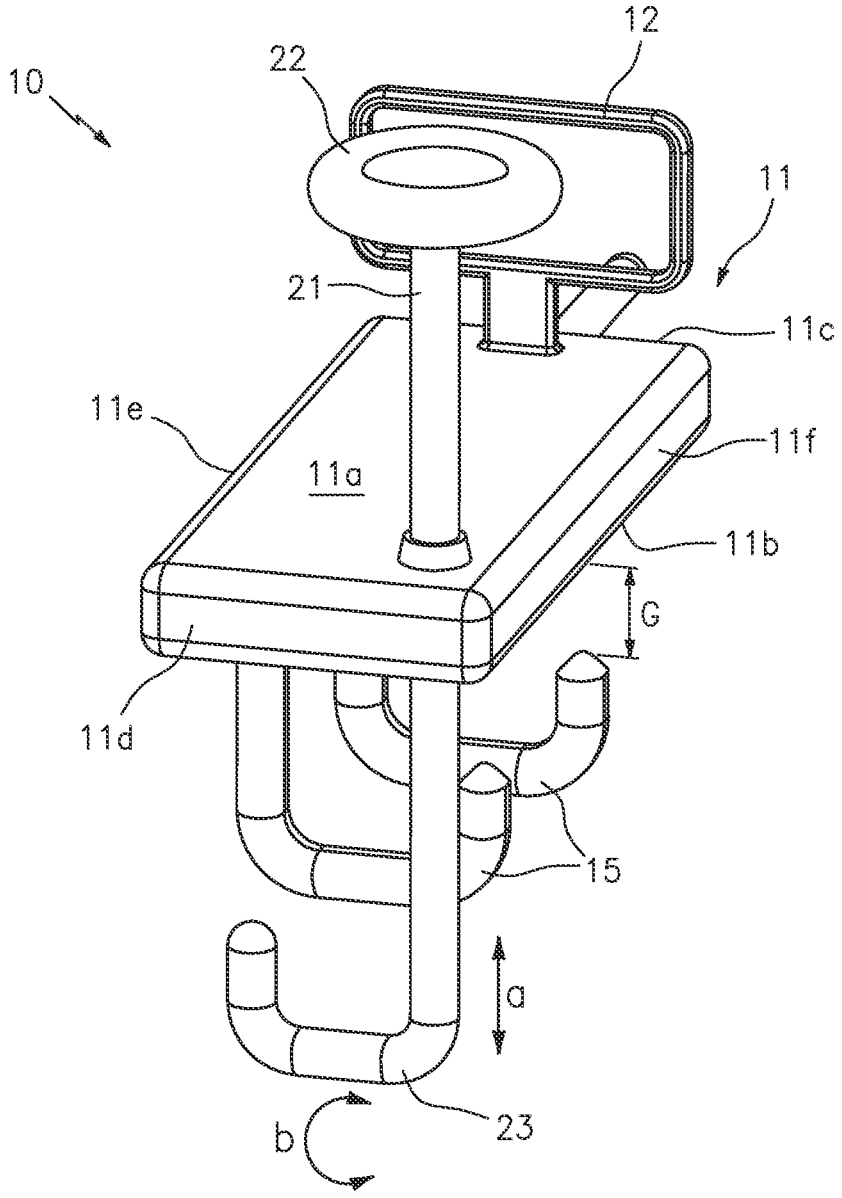
FIG. 2 is a back-side view of the control device for a fuel dispensing nozzle in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described herein, the term "removably secured," and derivatives thereof shall be used to describe a situation wherein two or more objects are joined together in a non-permanent manner so as to allow the same objects to be repeatedly joined and separated.

FIGS. 1-4 illustrate one embodiment of a gas pump control device 10 that is useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown, one embodiment of the device 10 can include an elongated main body member 11 which can function to support and orient each of the device components. In one embodiment, the main body member can include a generally rectangular-shape, and can include a top surface 11*a*, a bottom surface 11*b*, a front end 11*c*, a back end 11*d* and a pair of side surfaces 11*e* and 11*f*. In the preferred embodiment, the main body can be constructed from a lightweight plastic material so as to be easily cleaned and sanitized between uses.

Of course, the main body is not limited to any particular shape or size, as the same may be constructed to include any number of different shapes, sizes, lengths, widths and/or thicknesses, for example. Likewise, the main body 11 may be formed from any number of other materials that are, for example, relatively strong and stiff for their weight. Several nonlimiting examples include but are not limited to various lightweight metals or metal alloys (e.g., aluminum, or alloys thereof), and/or various composite materials (e.g., carbon fibers in a polymer matrix, fiberglass, etc.).

In one embodiment, a handle 12 can be positioned along the main body so as to aid a user in operating the device. In the preferred embodiment, the handle can be positioned adjacent to the front end 11*c* and can extend upward from the top surface 11*a*. Although illustrated as having a circular shape, this is for illustrative purposes only, as the handle may be constructed to include other shapes having a dedicated grasping area for a user's hand(s) to engage.

In one embodiment, an elongated protrusion 13 can extend outward from the front end of the device. The protrusion can preferably include a rubber or foam tip 13*a*, so as to permit the protrusion to function as a stylus that is readable by a standard touchscreen device. Of course, the protrusion may be located at other locations along the device components, and/or may be constructed from any number of other construction materials.

In one embodiment, an opening 14 extends through the top and bottom surfaces 11*a* and 11*b* of the main body at a location adjacent to both the back end 11*c* and the side surface 11*f*. The opening functioning to receive the rod 21 of the below described control member.

In one embodiment, a pair of generally hook-shaped nozzle engagement members 15 can extend downward from the side 11*e* of the main body. As shown, each of the nozzle engagement members can extend generally perpendicular to the main body, and can include a curved bottom surface 15*a*, and a raised distal end 15*b* that is located beneath the opposite side surface 11*f* of the main body.

This design providing a gap G between the distal end 15*b* of each of the engagement members 15, and the bottom end 11*b* of the main body for transversely receiving the handle portion of a gas pump nozzle. As such, the device 10 will be sized such that the gap has dimensions larger than the diameter of the nozzle handle so as to allow the handle to pass through the gap and to be engaged by the engagement members 15.

Although illustrated with regard to two identically shaped hook components, other embodiments are contemplated wherein additional engagement members are provided, and/or wherein the members include different shapes or sizes. Likewise, other embodiments are contemplated the orientation of the opening 14 and hook components 15 are reversed such that the opening is located adjacent to side 11*e*, and wherein the hook components extend downward from side 11*f*, to create the gap G beneath side 11*e*.

In either instance, one embodiment of the device 10 can include a control member which can function to allow a user to selectively manipulate the squeeze lever of a fuel pump nozzle to which the device is engaged. In the preferred embodiment, the control member can include an elongated rod 21 that is oriented perpendicular to the main body 11, and that is positioned through the opening 14. As shown by arrows a and b, the rod can slide up and down through opening 14 (e.g., slidingly engaged), while being able to rotate 360 degrees, respectively.

In the illustrated embodiment, the control member can also include a generally circular shaped control grip 22 along the top end of the rod, and a lever hook 23 along the bottom end of the rod. Of course, the control member is not limited to a circular-shaped control grip or a hook, as any number of other components capable of allowing a user to grip and manipulate the rod 21 in order to selectively activate the lever portion of a fuel pump nozzle are also contemplated.

Figure 3:
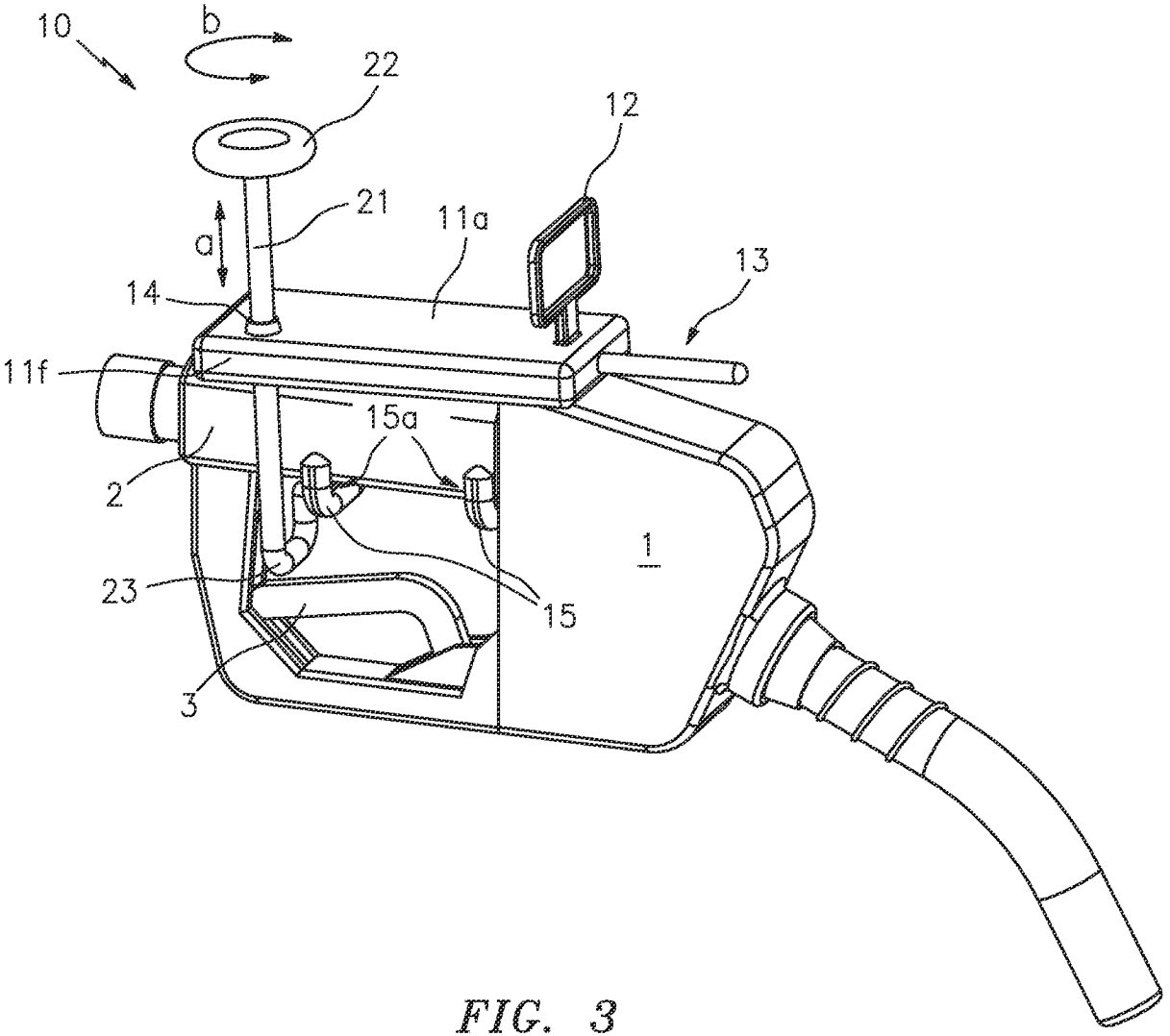
FIG. 3 is a perspective view of the control device for a fuel dispensing nozzle in operation, in accordance with one embodiment of the invention.
Figure 4:
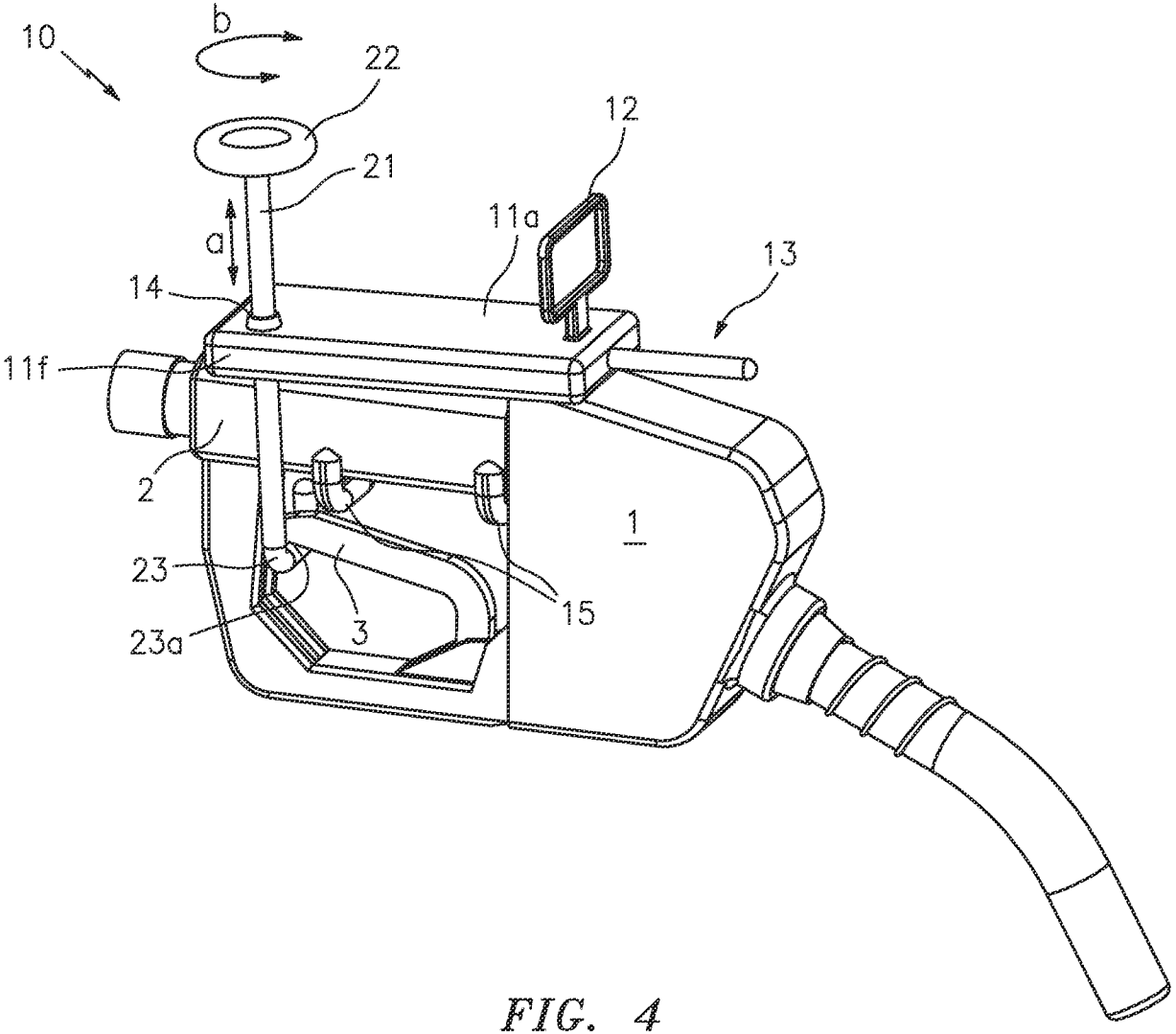
FIG. 4 is another perspective view of the control device for a fuel dispensing nozzle in operation, in accordance with one embodiment of the invention.

FIGS. 3 and 4 illustrate one embodiment of the device 10 in operation with a fuel nozzle 1. As shown, the main body can be manipulated so as to position the handle portion 2 of the fuel nozzle 1 through the gap G, until the bottom of the handle is in contact with the curved bottom surface 15*a* of the nozzle engagement members. When so engaged, a user holding the device handle 12 will be able to physically move the nozzle 1 between the nozzle bracket on the gas pump and the vehicle's fuel tank without having to physically touch the nozzle itself.

Next, the lever hook 23 can be manipulated by the control grip 22 until squeeze lever 3 of the nozzle 1 is resting along the curved surface 23*a* of the hook. When so positioned, the user can slide the rod 21 upward, thus squeezing the lever 3 to dispense fuel from the nozzle into the vehicle (or other approved receptacle) fuel tank. Moreover, it is noted that the rod extends along the opposite side of the nozzle handle during operation, thus bracketing the nozzle handle on both sides. Such a feature advantageously ensuring the nozzle does not slip from the device 10.

Upon completion of the fueling procedure, the above steps can be completed in reverse in order to return the fuel nozzle to the gas pump shelf. Moreover, at any time, the user can utilize the protrusion 13 to access the control panel of the pump. More specifically, the protrusion can be used to depress any physical pushbuttons on the pump, and the tip of the protrusion can be used to access any touchscreen displays.

Accordingly, the above described gas pump control device 10 can function to provide a user with a dedicated device for selectively engaging and dispensing fuel from a gas pump without having to physically touch the pump or nozzle itself, thus reducing the risk of harm or disease as described above.

As described herein, one or more elements of the gas pump control device 10 can be secured together utilizing any number of known attachments means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A control device for a fuel dispensing nozzle, said device comprising:

a main body having a top surface, a bottom surface, a front end, a back end, a first side surface and a second side surface;

a handle that extends upward from the top surface of the main body;

a pair of nozzle engagement members that extend downward from the bottom surface of the main body, each of the pair of nozzle engagement members including functionality for engaging a handle of a fuel nozzle; and a control member that is engaged with the main body, said control member including functionality for engaging a squeeze lever of the fuel nozzle, an elongated rod having a top end and a bottom end, a control grip that is positioned along the top end of the elongated rod, and a curved lever hook that is positioned along the bottom end of the elongated rod.

2. The device of claim 1, wherein each of the pair of nozzle engagement members comprise:

a hook having a curved bottom surface and a raised distal end.

3. The device of claim 2, wherein the raised distal end of each of the pair of nozzle engagement members is separated from the bottom surface of the main body by a gap.

4. The device of claim 3, wherein the gap includes a dimension that is greater than a diameter of the handle of the fuel nozzle.

5. The device of claim 1, wherein the elongated rod is positioned perpendicularly through the main body.

6. The device of claim 1, further comprising an opening along the top surface of the main body.

7. The device of claim 6 wherein a portion of the elongated rod is positioned through the opening.

8. The device of claim 6, wherein the elongated rod is slidingly engaged with the main body.

9. The device of claim 6, wherein the control grip is positioned above the top surface of the main body, and the lever hook is positioned beneath the bottom surface of the main body.

10. The device of claim 1, further comprising:

an elongated protrusion extending outward from the front end of the main body.

11. The device of claim 10, wherein a tip of the elongated protrusion is constructed from rubber or foam.

* * * * *